US009012820B2

(12) United States Patent
Christiansen et al.

(10) Patent No.: US 9,012,820 B2
(45) Date of Patent: Apr. 21, 2015

(54) METHOD AND ARRANGEMENT FOR DYNAMIC WAVE FORM CORRECTION

(75) Inventors: Erik Svend Christiansen, Faenza (IT); Laurent Jeanneteau, Compiegne (FR); Alex Viroli, Forli (IT); Massimo Zangoli, Santercangelo di Romagna (IT); Thibaut Rigolle, Forli (IT); Michael Herzog, Insingen (DE)

(73) Assignee: Electrolux Home Products Corporation N.V., Zaventem (BE)

( * ) Notice: Subject to any disclaimer, the term of this patent is extended or adjusted under 35 U.S.C. 154(b) by 1189 days.

(21) Appl. No.: 12/988,070

(22) PCT Filed: Mar. 3, 2009

(86) PCT No.: PCT/EP2009/001489

§ 371 (c)(1),
(2), (4) Date: Oct. 15, 2010

(87) PCT Pub. No.: WO2009/129889

PCT Pub. Date: Oct. 29, 2009

(65) Prior Publication Data

US 2011/0036832 A1 Feb. 17, 2011

(30) Foreign Application Priority Data

Apr. 25, 2008 (EP) ..... 08007985

(51) Int. Cl.
*H05B 6/04* (2006.01)
*H05B 6/06* (2006.01)

(52) U.S. Cl.
CPC ... *H05B 6/06* (2013.01); *H05B 6/04* (2013.01)

(58) Field of Classification Search
CPC ..... H05B 6/04; H05B 6/06; H05B 6/40; H05B 6/065
USPC ..... 219/660, 661, 666, 670, 760, 761, 624, 219/664; 373/147–150, 145
See application file for complete search history.

(56) References Cited

U.S. PATENT DOCUMENTS 4,223,195 A * 9/1980 Bechtel ..... 219/760
4,713,744 A * 12/1987 Coston ..... 363/160

(Continued)

FOREIGN PATENT DOCUMENTS

EP 1734789 12/2006

OTHER PUBLICATIONS

International Search Report for PCT/EP2009/001489, dated Jul. 23, 2009, 2 pages.

*Primary Examiner* — Tu B Hoang
*Assistant Examiner* — Hung D Nguyen
(74) *Attorney, Agent, or Firm* — Pearne & Gordon LLP

(57) ABSTRACT

A method for dynamic wave form correction includes providing an input power signal by an AC power source and rectifying the input power signal by a frequency converter into a half waves signal whose half wave is delimited by two subsequent zero-crossings. The time lag between the two zero-crossings defines a half wave duration. The frequency converter converts the half waves signal into a working current signal for supplying an induction heating device. In a frequency shifting operation, the frequency of the working signal is first increased from a first base frequency to a maximum frequency, and is then decreased to a second base frequency different from the first base frequency within a time period smaller than the half wave duration. A zero crossing of the half wave signal is passed within the frequency shifting operation. An arrangement for dynamic wave form correction of a power supply is also provided.

15 Claims, 2 Drawing Sheets

(56) References Cited

Figure 1:
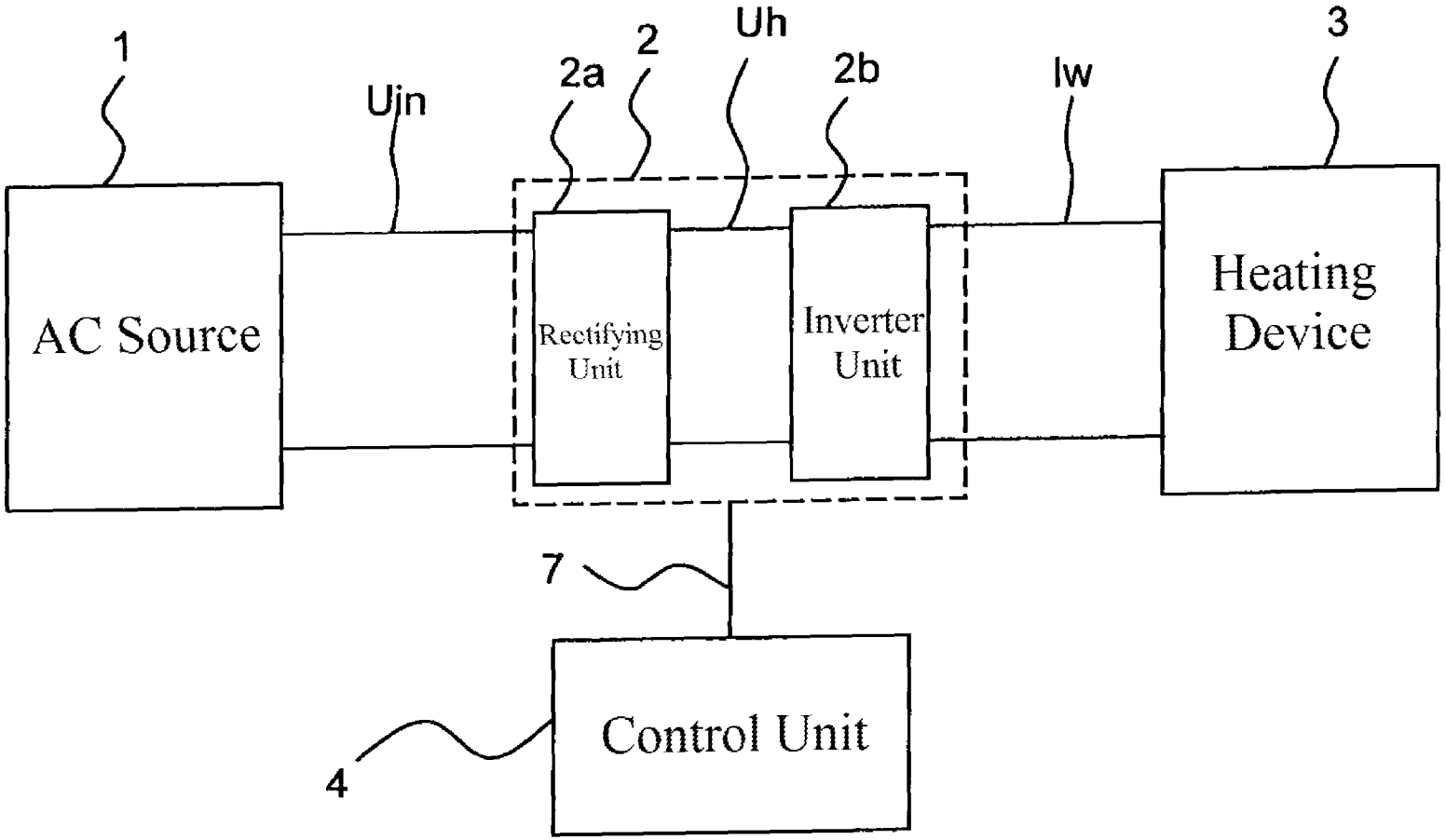

U.S. PATENT DOCUMENTS 5,714,739 A * 2/1998 Irrera et al. ..... 219/626
6,450,241 B1 * 9/2002 Lehman ..... 164/468
6,696,770 B2 * 2/2004 Nadot et al. ..... 219/662
2002/0122456 A1 * 9/2002 Fishman et al. ..... 373/150
2006/0118549 A1 * 6/2006 Fishman et al. ..... 219/656

* cited by examiner

METHOD AND ARRANGEMENT FOR DYNAMIC WAVE FORM CORRECTION

The invention relates to a method and an arrangement for dynamic wave form correction of a power supply of an induction heating device.

Induction heating devices are usually heated and/or powered by working signals, especially by current working signals or the variation of current working signals, which are normally generated or converted in a frequency converter from at least one input power signal provided by an AC power source. The working signals normally comprise a higher frequency than the input power signals.

In many cases, the regulation of the heating power is done by a variation of the frequency of the working signal. Therefore, it is an object of the invention to find a way to vary the frequency of the working signal in a new and advantageous way.

This object is solved by an arrangement and a method for dynamic wave form correction of a power supply of an induction heating device as described below.

Advantageous embodiments are also described.

The invention relates to a method for dynamic wave form correction of a power supply of an induction heating device, a) where an input power signal, especially an input voltage signal, comprising waves with an input power frequency is provided by an AC power source,
b) where a frequency converter rectifies the input power signal into a half waves signal, especially a half wave voltage signal,
b1) where a half wave of the half waves signal is delimited by two subsequent zero-crossings,
b2) where the time lag between the two zero-crossings defines a half wave duration,
c) where the frequency converter further converts the half waves signal into to a working signal, especially a working current signal, for supplying the induction heating device,
d) where in a frequency shifting operation a working frequency of the working signal is first increased from a first working base frequency to a maximum frequency and then decreased to a second base frequency within a time, which is smaller than the half wave duration,
e) where the first working base frequency is not equal to the second working base frequency and/or a zero crossing of the half wave signal is passed within the frequency shifting operation.

The invention allows a flexible variation of the working signal, as there are at least two working base frequencies between which the working signal can be switched or a zero crossing of the half wave signal is passed within the frequency shifting operation, so that also a shifting in the time or phase direction is possible.

A zero crossing of the half wave signal corresponds in this context to a time where the amplitude of the input power signal is zero, as the current value of the signal changes from a positive to a negative value. Even if the half wave signal should not change from a positive to a negative value at this point, but only touch the value zero, the term zero crossing is also used for this context. As an alternative, the term zero point can be used for the half wave signal.

Particularly, in a subsequent frequency shifting operation the working frequency of the working signal is first increased from the second working frequency to a maximum frequency and then decreased to the first working frequency or to a third working frequency within the half wave duration, where preferably a, particularly further, zero crossing of the half wave signal is passed within the frequency shifting operation.

This enables or eases the repeated execution of frequency shifting operations as, at least after executing the subsequent frequency shifting operation, the first working frequency can be reached again, so that the next frequency shifting operation can be added.

Preferably, a number of n>1 frequency shifting operations is executed one after another, a) where the frequency shifting operations start at different working base frequencies and end at the starting working base frequency of the subsequent frequency shifting operation, where preferably the last frequency shifting operation ends at the starting working lose frequency of the first frequency shifting operation and/or
b) where the frequency shifting operations have different time-lags with respect to a corresponding half-wave of the half waves signal.

This embodiment can increase the flexibility for a variation of the frequency even more, as a number of up to n>1 different working base frequencies and/or time lags can be selected.

In an advantageous embodiment, a) the frequency shifting operation (5) and the subsequent frequency shifting operation (6) are executed alternating and/or
b) the number of n frequency shifting operations are executed repeatedly and/or
c) the working base frequencies (f1, f2) are equal.

In another advantageous embodiment, at least one frequency shifting operation comprises a time span before the increasing of the frequency and/or after decreasing the frequency and/or while the working frequency has the maximum value, where the working frequency is hold constant. This can reduce the times where frequency modulation is executed and thus reduce the controlling effort during these times.

Particularly, at least one frequency shifting operation starts and/or ends at a zero-crossing. This has the advantage, that an at least relatively high correlation with respect to the amplitude of the half waves signal is given.

In an alternative, but also advantageous embodiment, at least one frequency shifting operation starts after a timespan of a zero crossing.

In an advantageous embodiment, the working signal, after a working base frequency has been reached, is changing its gradient, particularly from a negative to a zero or a positive value. This is particularly executed at the transition from increasing or decreasing the signal to a period where the signal is constant.

Particularly, the values of the second working base frequency and maximum working frequency are derived from the first working base frequency and from a counter frequency, where especially the ratio of the frequency difference of the second working base frequency from the first working base frequency and the difference of the maximum working frequency from the first working base frequency is constant. This eases the implementation of an controlling algorithm for the generation of the different signals.

In an advantageous embodiment, a) the value of the second working base frequency is derived from the first working base frequency and from a counter frequency by a division of the counter frequency by the difference of the ratio of the counter frequency and the first working base frequency and a first modulation value and/or
b) the value of the maximum working frequency is derived from the first working base frequency and from a counter frequency by a division of the counter frequency by the difference of the ratio of the counter frequency and the first working base frequency and a second modulation value.

Particularly, the first modulation value is 8 and the second modulation value is 25 and/or the counter frequency is between 4 and 100 MHz, especially 10 Mhz.

Furthermore, the invention relates to an arrangement for dynamic wave form correction of a power supply of an induction heating device, a) with an AC power source for providing an input power signal, especially an input voltage signal, comprising waves with an input power frequency, b) with a frequency converter for rectifying the input power signal into a half waves signal, especially a half wave voltage signal, b1) where a half wave of the half waves signal is delimited by two subsequent zero-crossings, b2) where the time lag between the two zero-crossings defines a half wave duration, c) where by the frequency converter further the half waves signal is convertable into to a working signal, especially a working current signal, for supplying the induction heating device, d) where in a frequency shifting operation a working frequency of the working signal is first increasable from a first working base frequency to a maximum frequency and then decreasable to a second working base frequency within a time, which is smaller than the half wave duration, e) where the first working base frequency is not equal to the second working base frequency and/or a zero crossing of the half wave signal is passed or passable within the frequency shifting operation.

In an advantageous embodiment, the converter comprises at least one full bridge and/or at least one half bridge and/or a single switch.

Figure 2:
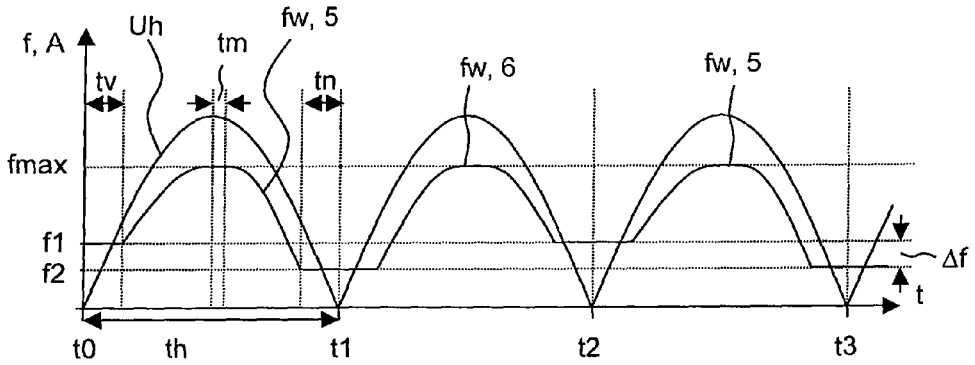
Figure 3:
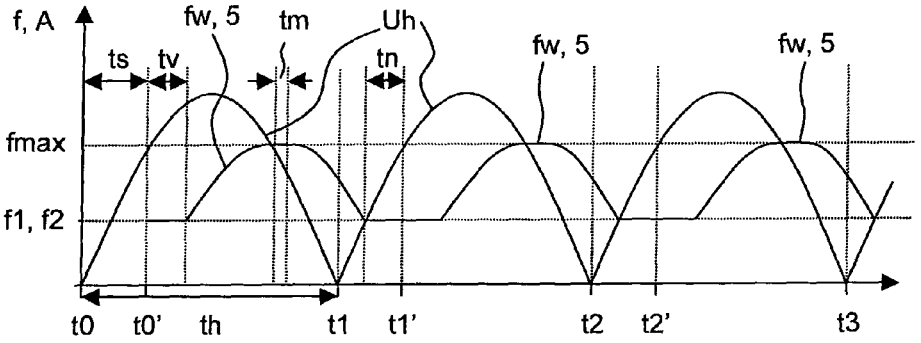
Figure 4:
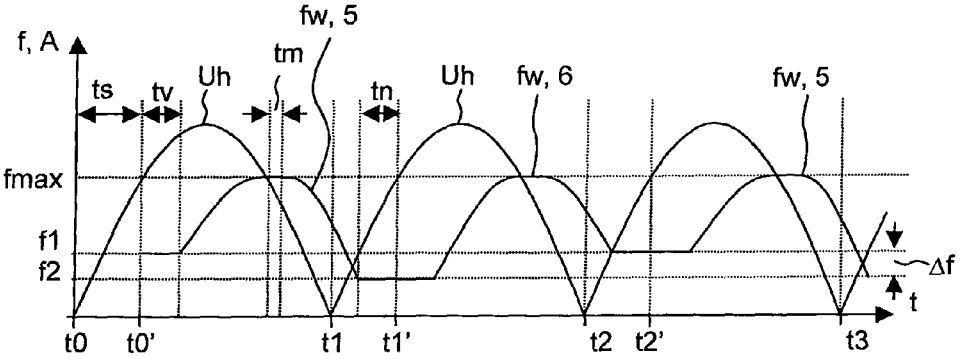

The invention will be described in further details with references to the drawings, in which FIG. 1 shows a block diagram of embodiments according to the invention, FIG. 2 shows an embodiment where the first working base frequency is not equal to the second working base frequency, FIG. 3 shows a second embodiment of the invention where the zero crossing is arranged within the first frequency shifting operation and FIG. 4 shows a third embodiment, where the first working base frequency is not equal to the second working base frequency and the zero crossing is arranged within the first frequency shifting operation.

FIG. 1 shows a block diagram of embodiments according to the invention, with an AC source 1, supplying a frequency converter 2 with an input signal Uin, where the output signal Iw of the frequency converter 2 is passed to the induction heating device 3.

In the embodiments, the input signal Uin is a voltage signal, particularly with an amplitude of about 230 V. Alternatively, a voltage amplitude of about 110 V is possible.

The input power frequency can be 50 Hz or 60 Hz. Alternatively, the input power frequency can be 400 Hz, for example for use in boats or for camping, as this can reduce the size of the device.

The output signal Iw, which is, in the embodiments, a current signal, transmits the generated current for driving the induction heating device 3, which especially contains or is implemented by one or several induction coils.

Inside the frequency converter 2, the input voltage signal Uin is first rectified in the rectifying unit 2*a* to a voltage signal Uh containing the half waves of the input voltage signal Uin. After that, a high frequency current working signal Iw with a working frequency fW is generated in the inverter unit 2*b*, for example using IGBTs in a half bridge circuit or a full bridge circuit or a single switch. The behaviour of the frequency converter 2 is controlled by a control unit 4 which is connected to the frequency converter 2 by control lines 7.

In FIGS. 2 to 4, the half waves signal Uh shows the amplitude A of about three half waves of the rectified input signal Uin between the times t0 and t1, t1 and t2 as well as between the times t2 and t3. Also, the variation of the working frequency fw of the working signal Iw over the time t is shown in FIGS. 2 to 4.

In the embodiment according to FIG. 2, a frequency shifting operation 5 is shown between the times t0 and t1. The frequency fw of the working signal Iw is first kept constant at a working base frequency f1 for a time duration tv. Afterwards, the frequency is increased to a frequency fmax, where the frequency is held constant for a time duration tm. After that, the frequency is decreased to a working base frequency f2. Finally, during the remaining time to until t1, the frequency fw of the current working signal Iw remains constant.

During the following half waves between t1 and t2, a subsequent frequency shifting operation 6 is executed.

The frequency fw remains constant for the time tv, and is then increased again to a frequency fmax, then held constant for a time tm and finally decreased again to the working base frequency f1, where it remains constant until t2.

Afterwards, the described behaviour is repeated between t2 and t3, and t3 and, not shown, t4.

FIG. 3 shows another embodiment of the invention, where the frequency shifting operation 5 is executed between t0' and t1' and therefore shifted by a time span ts with respect to the half wave arranged between t0 and t1. Again, the working base frequency f1 is held constant for a time duration tv and then increased to the frequency fmax. Also in the embodiment according to FIG. 2, the frequency fw is then held constant for a time span tm. Afterwards, the frequency is decreased to the value f2, which is, in this embodiment, equal to f1.

The time, when the value f2 or f1 is reached again, is arranged after the end t1 of the first half wave. Afterwards, the frequency is constant for a time span tn until t1'.

The same procedure is repeated between t1' and t2' and set forth in the following half waves.

FIG. 4 shows a third embodiment, where the behaviour of embodiment 1 and embodiment 2 is combined.

The frequency shifting operation 5 is executed between t0' and t1' and therefore shifted by a time span ts with respect to the half wave arranged between t0 and t1. The working base frequency f1 is held constant for a time duration tv and then increased to the frequency fmax. Also in the embodiment according to FIG. 4, the frequency fw is then held constant for a time span tm. Afterwards, the frequency is decreased to the value f2, which is, in the embodiment, smaller than f1.

The time, when the value f2 is reached, is arranged after the end t1 of the first half wave. Afterwards, the frequency is constant for a time span tn until t1'.

The same procedure is repeated between t1' and t2' and set forth in the following half waves.

In the embodiments, the ratio between the deviation of fmax with respect to f2 divided by the deviation of f1 with respect to f2 is equal to 31%.

These values are received by dividing the value of the counter frequency by the counter frequency divided by the base frequency f2 after subtracting different values for f1 and fmax. The counter frequency can be 4 MHz to 100 Mhz.

In the following examples, the value for the counter frequency will be 10 MHz, whereas the value for f1 is 8 and the value for fmax is 25.

In a first example, with a value of 19.000 Hz for f2, values of 19.293 for f1 and 19.947 Hz for fmax are received.

In a second example, with a value of 19.000 Hz for f2, a first frequency f1 is located at 25.510 Hz and a maximum frequency fmax is located at a value of 26.666 Hz.

LIST OF REFERENCE SIGNS

1 AC-source
2 frequency converter
2*a* rectifying unit
2*b* inverter unit
3 induction heating device
4 control unit
5 frequency shifting operation
6 subsequent frequency shifting operation
7 control lines
A amplitude
f frequency
f1 first working base frequency
f2 second working base frequency
fin input power frequency
fmax maximum frequency
fw working frequency
m1 first modulation value
m2 second modulation value
t time
tv,
tn,
tm time spans
th have wave duration
th half wave duration
Iw working signal
Uh half waves signal
Uin input power signal

The invention claimed is:

1. A method for dynamic wave form correction of a power supply of an induction heating device (3) comprising the steps of:

a) providing an input power signal (Uin), comprising waves with an input power frequency (fin) by an AC power source (1), b) rectifying the input power signal (Uin) into a half waves signal (Uh) by a frequency converter (2), wherein:

b1) a half wave of the half waves signal (Uh) is delimited by two subsequent zero-crossings (t0, t1; t1, t2; t2, t3), and b2) where the time lag between the two subsequent zero-crossings (t0, t1; t1, t2; t2, t3) defines a half wave duration (th), c) converting the half waves signal (Uh) by the frequency converter (2) into to a working signal (Iw), for supplying the induction heating device (3), and d) performing a frequency shifting operation (5) by first increasing a working frequency (fw) of the working signal (Iw) from a first working base frequency (f1) to a maximum frequency (fmax)

and subsequently decreasing the working frequency (fw) of the working signal (Iw) to a second working base frequency (f2) within a time period, which is smaller than the half wave duration (th), wherein at least one of the following conditions is met:

1) the first working base frequency (f1) is not equal to the second working base frequency (f2) and 2) a zero crossing (t0, t1; t2, t3) of the half waves signal (Uh) is passed within the frequency shifting operation.

2. The method according to claim 1, further comprising the step of performing a subsequent frequency shifting operation (6) by first increasing the working frequency (fw) of the working signal (Iw) from the second working base frequency (f2) to a maximum frequency (fmax) and then decreased subsequently decreasing the working frequency (fw) of the working signal (Iw) to the first working base frequency (f1) or to a third working base frequency within the half wave duration (th).

3. The method according to claim 2, wherein at least one of the following conditions is met:

a) the frequency shifting operation (5) and the subsequent frequency shifting operation (6) are executed alternating, b) a number of n>1 frequency shifting operations are executed repeatedly, and c) the working base frequencies (f1, f2) are equal.

4. The method according to claim 2, where at least one frequency shifting operation (5, 6) starts at a zero-crossing (t0, t1; t2, t3) or after a timespan (ts) of the zero crossing (t0, t1; t2, t3).

5. The method according to claim 2, wherein a zero crossing (t0, t1; t2, t3) of the half waves signal (Uh) is passed within the frequency shifting operation (6).

6. The method according to claim 1, where n>1 frequency shifting operations are executed one after another, wherein at least one of the following conditions is met:

a) the frequency shifting operations start at different working base frequencies and end at the starting working base frequency of the subsequent frequency shifting operations, and b) the frequency shifting operations have different time lags with respect to a corresponding half-wave of the half waves signal (Uh).

7. The method according to claim 6, wherein the last frequency shifting operation ends at the starting working base frequency of the first frequency shifting operation.

8. The method according to claim 1, wherein at least one of the following conditions is met:

(a) at least one frequency shifting operation (5, 6) comprises a timespan before the increasing of the frequency (tv), (b) after decreasing the frequency (tn), and (c) while the working frequency (fw) has the maximum value (tm), where the working frequency (fw) is held constant.

9. The method according to claim 1, where the working signal (Iw), after a working base frequency (f1, f2) has been reached, is changing its gradient from a negative value to a zero or to a positive value.

10. The method according to claim 1, where the values of the second working base frequency (f2) and the maximum frequency (fmax) are derived from the first working base frequency (f1) and from a counter frequency (fc), where the ratio of the frequency difference between the second working base frequency (f2) and the first working base frequency (f1) to the difference between the maximum frequency (fmax) and the first working base frequency (f1) is constant.

11. The method according to claim 1, wherein at least one of the following conditions is met:

a) a value of the second working base frequency (f2) is derived from the first working base frequency (f1) and from a counter frequency (fc) by a division of the counter frequency (fc) by the difference between the ratio of the counter frequency (fc) to the first working base frequency (f1) and a first modulation value (m1), and b) the value of the maximum frequency (fmax) is derived from the first working base frequency (f1) and from a counter frequency (fc) by a division of the counter frequency (fc) by the difference between the ratio of the counter frequency (fc) to the first working base frequency (f1) and a second modulation value (m2).

12. The method according to claim 11, wherein at least one of the following conditions is met:

(a) the first modulation value (m1) is 8 and the second modulation value (m2) is 25, and (b) the counter frequency (fc) is between 4 and 100 MHz.

13. The method according to claim 1, wherein the input power signal (Uin) is an input voltage signal, the half waves signal (Uh) is a half wave voltage signal, and the working signal (Iw) is a working current signal.

14. The method according to claim 12, wherein the counter frequency (fc) is 10 Mhz.

15. An arrangement for dynamic wave form correction of a power supply of an induction heating device (3), comprising, a) an AC power source (1) for providing an input power signal (Uin), comprising waves with an input power frequency (fin), and b) a frequency converter (2) for rectifying the input power signal (Uin) into a half waves signal (Uh) and further converting the half waves signal (Uh) into a working signal (Iw), for supplying the induction heating device (3), wherein:

b1) where the frequency converter (2) comprises at least one of the following elements:

(1) a full bridge, (2) at least one half bridge, and (3) a single switch, b2) a half wave of the half waves signal (Uh) is delimited by two subsequent zero-crossings (t0, t1; t1, t2; t2, t3), b3) the time lag between the two subsequent zero-crossings (t0, t1; t1, t2; t2, t3) defines a half wave duration (th), b4) in a frequency shifting operation (5), a working frequency (fw) of the working signal (Iw) is first increasable from a first working base frequency (f1) to a maximum frequency (fmax) and then decreasable to a second working base frequency (f2) within a time which is smaller than the half wave duration (th), wherein at least one of the following conditions is met:

1) the first working base frequency (f1) is not equal to the second working base frequency (f2), and 2) a zero crossing (t0, t1; t2, t3) of the half waves signal (Uh) is passed or passable within the frequency shifting operation.

* * * * *

UNITED STATES PATENT AND TRADEMARK OFFICE

CERTIFICATE OF CORRECTION

PATENT NO. : 9,012,820 B2
APPLICATION NO. : 12/988070
DATED : April 21, 2015
INVENTOR(S) : Christiansen et al.

It is certified that error appears in the above-identified patent and that said Letters Patent is hereby corrected as shown below:

In the claims,

Column 6, claim 2, line 2, please replace "and then decreased subsequently" with
-- and subsequently --

Column 8, claim 15, line 1, please replace "b1) where the" with -- b1) the --

Column 8, claim 15, lines 15-16, please replace "a time which" with -- a time period, which --

Signed and Sealed this
First Day of March, 2016

Michelle K. Lee

Michelle K. Lee
*Director of the United States Patent and Trademark Office*